US009215942B2

(12) United States Patent
Bodum

(10) Patent No.: US 9,215,942 B2
(45) Date of Patent: Dec. 22, 2015

(54) CLOSURE FOR A BEVERAGE CONTAINER

(75) Inventor: Jørgen Bodum, Meggen (CH)

(73) Assignee: PI-DESIGN AG, Triengen (CH)

( * ) Notice: Subject to any disclaimer, the term of this patent is extended or adjusted under 35 U.S.C. 154(b) by 0 days.

(21) Appl. No.: 13/148,413

(22) PCT Filed: Feb. 9, 2009

(86) PCT No.: PCT/CH2009/000050

§ 371 (c)(1),
(2), (4) Date: Aug. 8, 2011

(87) PCT Pub. No.: WO2010/003259

PCT Pub. Date: Jan. 14, 2010

(65) Prior Publication Data

US 2011/0309094 A1 Dec. 22, 2011

(51) Int. Cl.
*A47G 19/22* (2006.01)

(52) U.S. Cl.
CPC ..... *A47G 19/2272* (2013.01)

(58) Field of Classification Search
CPC ..... B01L 3/50825; B65D 41/28; A47G 19/2272; A47G 19/22
USPC ..... 220/715, 703, 711, 713, 714, 220/259.3–259.4, 254.8, 255; 49/464; 222/131
See application file for complete search history.

(56) References Cited

U.S. PATENT DOCUMENTS

| | | | | |
|---|---|---|---|---|
| 3,338,467 | A | 8/1967 | Albert | |
| 3,776,433 | A * | 12/1973 | De Treitas | 222/519 |
| 4,497,422 | A * | 2/1985 | Klees | 222/482 |
| 4,796,785 | A * | 1/1989 | Merritt | 222/131 |
| 4,938,375 | A * | 7/1990 | Fantacone | 220/709 |
| 5,249,703 | A | 10/1993 | Karp | |
| 5,477,979 | A * | 12/1995 | Goessling et al. | 220/713 |
| 5,680,951 | A * | 10/1997 | Feltman et al. | 220/253 |
| 6,102,244 | A | 8/2000 | Kuwano et al. | |
| 6,202,877 | B1 * | 3/2001 | La Torre et al. | 220/254.1 |
| 6,783,020 | B2 * | 8/2004 | Featherston et al. | 220/254.8 |
| 6,889,859 | B1 * | 5/2005 | Leon | 220/254.3 |
| 2003/0209547 | A1 | 11/2003 | Lin | |
| 2004/0040962 | A1 * | 3/2004 | Bielecki et al. | 220/254.1 |
| 2004/0094552 | A1 | 5/2004 | Featherston et al. | |
| 2008/0156803 | A1 * | 7/2008 | McClellan et al. | 220/254.1 |

FOREIGN PATENT DOCUMENTS

| | | | |
|---|---|---|---|
| JP | 2003501315 | A | 1/2003 |
| WO | 0022969 | A1 | 4/2000 |

OTHER PUBLICATIONS

International Preliminary Report on Patentability issued on Aug. 9, 2011 for corresponding application PCT/CH2009/000050.
International Search Report of PCT/CH2009/000050 dated Nov. 6, 2009.

* cited by examiner

*Primary Examiner* — Anthony Stashick
*Assistant Examiner* — James M Van Buskirk
(74) *Attorney, Agent, or Firm* — Sughrue Mion, PLLC

(57) ABSTRACT

A closure for a beverage container is disclosed. Said closure comprises an inserted element (2) and a closing member (3) which can be inserted into a mouth of the inserted element (2). A first engaging structure (22) mounted on the internal face of the inserted element (2) can be connected to a second engaging structure (36) arranged on the external face of the closing member (3). The inserted element (2) further has a funnel section (25) above the first engaging structure (22). The closing member (3) has a closed top surface (32), a handle element (31), and an apron (35) with outlets (33). The engaging structures (22, 36) are designed such that the closing member (3) can be moved relative to the inserted element in a vertical direction between a first position in which the closing member (3) seals the mouth and a second position in which the outlets (33) open passages for a liquid.

14 Claims, 4 Drawing Sheets

CLOSURE FOR A BEVERAGE CONTAINER

CROSS REFERENCE TO RELATED APPLICATIONS

This application is a National Stage of International Application No. PCT/CH2009/000050 filed Feb. 9, 2009, the contents of all of which are incorporated herein by reference in their entirety.

TECHNICAL FIELD

The present invention relates to a closure for a beverage container having an upwardly open vessel and to a beverage container having such a closure.

PRIOR ART

Beverage containers, in particular so-called "travel mugs", which have a closure in order to keep a beverage hot or cold have long been known from the prior art. These beverage containers normally comprise a vessel having an upper opening, an internal thread being placed in the region of the opening, as well as a lid, which can be screwed into the internal thread and thus allows a sealing connection between the vessel and the lid.

In order to ensure improved thermal insulation and avoid unwanted spillage of the vessel content when the user drinks from the beverage container, while on the move, for example, beverage containers in which the lid does not have to be removed from the container as a drink is taken are advantageous. The lid is therefore often designed and connected to the vessel such that, by simple manipulation, it opens up an outward passage for a liquid contained in the vessel, without having to be completely removed from the container for this purpose. In addition, the vessel or lid in many "travel mugs" has a raised rim, which forms a drinking edge and, on the one hand, facilitates direct drinking from the beverage container and, on the other hand, collects splashed liquid and returns it to the container. Examples of such beverage containers are described in U.S. Pat. Nos. 5,249,703, 3,338,467, US 2003/0209547 and U.S. Pat. No. 6,102,244.

Most of these beverage containers consist of a multiplicity of individual parts and have a complicated structure. They are hence complex and expensive to produce. The user can also gain access to the individual parts, for cleaning purposes, only with difficulty.

SUMMARY OF THE INVENTION

An object of the present invention is thus to provide a closure for a beverage container, which closure has a simple construction with few individual parts and offers easy and secure handling for the user. For the achievement of this object, a closure for a beverage container, is proposed having the following features:

an insert element for use in a vessel, the insert element having a continuous closure opening, a first engaging structure on the inner side of the closure opening and a raised, circumferential rim, which extends upward from the first engaging structure and forms a drinking edge or pouring edge; and a closure body insertable into the closure opening of the insert element and having a closed top surface and a circumferential apron extending downward from the top surface, which apron has a plurality of (at least three, preferably at least 10, particularly preferably 15-40) discharge openings distributed evenly along a peripheral direction, and a second engaging structure complementary to the first engaging structure, the engaging structures being configured such that the closure body is movable in the vertical direction relative to the insert element between a first position, in which it seals the closure opening, and a second position, in which the discharge openings open up passages for a liquid.

A thus designed closure for a beverage container consists of very few individual parts and is hence simple and inexpensive to produce. In particular, the closure is easy to operate for the user. For drinking purposes, the user moves the closure body from the first into the second position, whereby the discharge openings, which preferably extend in the radial direction, open up passages for the liquid. The closure body does not have to be completely removed from the insert element for this purpose. The raised, circumferential rim, which preferably forms an upwardly flared funnel region, collects the liquid escaping from the discharge openings, which liquid leaves this region again in bunched form. The rim therefore preferably has such a design with sufficiently great height that the liquid is fed in sufficiently bunched form to the mouth of the user when the beverage container is tilted for drinking purposes.

In order to make the beverage container easier to handle for the user, a grip element is preferably attached to the top side of the top surface of the closure body. Moreover, the closure body is in its entirety preferably designed and connected to the insert element such that the user does not bang against the closure body with the lip or nose when drinking directly from the beverage container.

All indications of place and direction such as top, bottom, vertical, etc. respectively relate to a beverage container standing upright with respect to the direction of gravity, the closure with insert element and therein inserted closure body being inserted in a vessel in the manner intended.

Preferably, at least two downwardly projecting, radially outward pointing hooks are arranged on the apron, which hooks prevent complete removal of the closure body from the insert element by butting against a bottom edge of the insert element as the closure is withdrawn from the insert element.

The hooks are preferably of flexible configuration, so that a complete removal of the closure body from the insert element is possible by pressing of the hooks radially inward. To this end, the user can previously remove the insert element, with the closure body inserted therein, from the vessel, in order to gain better access to the hooks. In particular, precisely two hooks can be arranged on the apron, whereby the user can press these inward in a simple manner, for example with thumb and index finger.

The hooks preferably consist of an element extending downward from the apron, and a radially outward pointing projection attached to the lower end of this element. In order to make the hooks flexible, the downward extending element can, for example, taper in certain regions, or can consist of a plurality of, in particular two, struts, which at their lower end are connected by the radially outward pointing projection.

The downward extending elements of the hooks preferably have a length which is slightly greater than the vertical height of the first engaging structure. The connection between the first and the second engaging structure can be completely separated, yet complete removal of the closure body from the insert element is prevented by the hooks.

The closure body preferably has a sealing element, which is arranged on a radial outer side of the apron above the discharge openings and which in the first position comes to lie between the closure body and the insert element and thereby seals off the closure opening. The sealing element can be constituted, in particular, by an O-ring.

The first engaging structure is preferably configured as an internal thread and the second engaging structure as an external thread.

Preferably, the passages have a cross-sectional area which is variable by the position of the closure body between the first and the second position. The user can thus regulate the quantity of liquid escaping through the closure opening by choosing an optional position of the closure body between the first and the second position.

The discharge openings can be configured as through holes, which are arranged within the apron and are surrounded on all sides by parts of the apron.

In a preferred embodiment, the discharge openings are arranged above the second engaging structure. They are thus in this case arranged between the sealing element and the second engaging structure, insofar as a sealing element is present.

The discharge openings can also, however, be configured as cut-outs, which are open toward the lower end of the apron.

The discharge openings can also be arranged such that they overlap with the second engaging structure. In this case, the second engaging structure is interrupted by the discharge openings and is located at least at the same height as the discharge openings with respect to the vertical.

In addition, the present invention provides a beverage container having the following features:

a closure according to the above description; and an upwardly open vessel having a vessel bottom, an upper vessel opening and a circumferential vessel side wall, the insert element being insertable into the upper vessel opening and being connectable to the vessel side wall.

In a preferred embodiment, the vessel is of double-walled configuration. The thermal insulation of the vessel in the outward direction is thereby improved.

For the connection of the vessel to the insert element, the vessel side wall preferably has in the region of the upper vessel opening on the radial inner side a first connecting structure. In addition, the insert element preferably has on its outer side a second connecting structure, which is configured so as to be complementary to the first connecting structure. The first connecting structure can be configured, in particular, as an internal thread and the second connecting structure as an external thread. In order to mutually seal the vessel and the insert element, a sealing element, for example an O-ring, is preferably mounted on the radial outer side of the insert element. The connection between the vessel and the insert element can also, however, be produced by bonding or welding.

In addition, the present invention provides a beverage container having the following features:

an upwardly open vessel, which has a vessel bottom, an upper vessel opening, a circumferential vessel side wall, which has in the region of the vessel opening on the radial inner side a first engaging structure, and a raised, circumferential rim, which latter extends upward from the first engaging structure and forms a drinking edge or pouring edge; and a closure body insertable into the closure opening and having a closed top surface and a circumferential apron extending downward from the top surface, which apron has a plurality of discharge openings evenly distributed along a peripheral direction and a second engaging structure complementary to the first engaging structure, the engaging structures being configured such that the closure body is movable in the vertical direction relative to the vessel between a first position, in which it seals the vessel opening, and a second position, in which the discharge openings open up passages for a liquid.

BRIEF DESCRIPTION OF THE DRAWINGS

Preferred embodiments of the invention are described below with reference to the drawings, which serve merely for the purpose of illustration and should not be interpreted as limiting. In the drawings.

DESCRIPTION OF PREFERRED EMBODIMENTS

Figure 1:
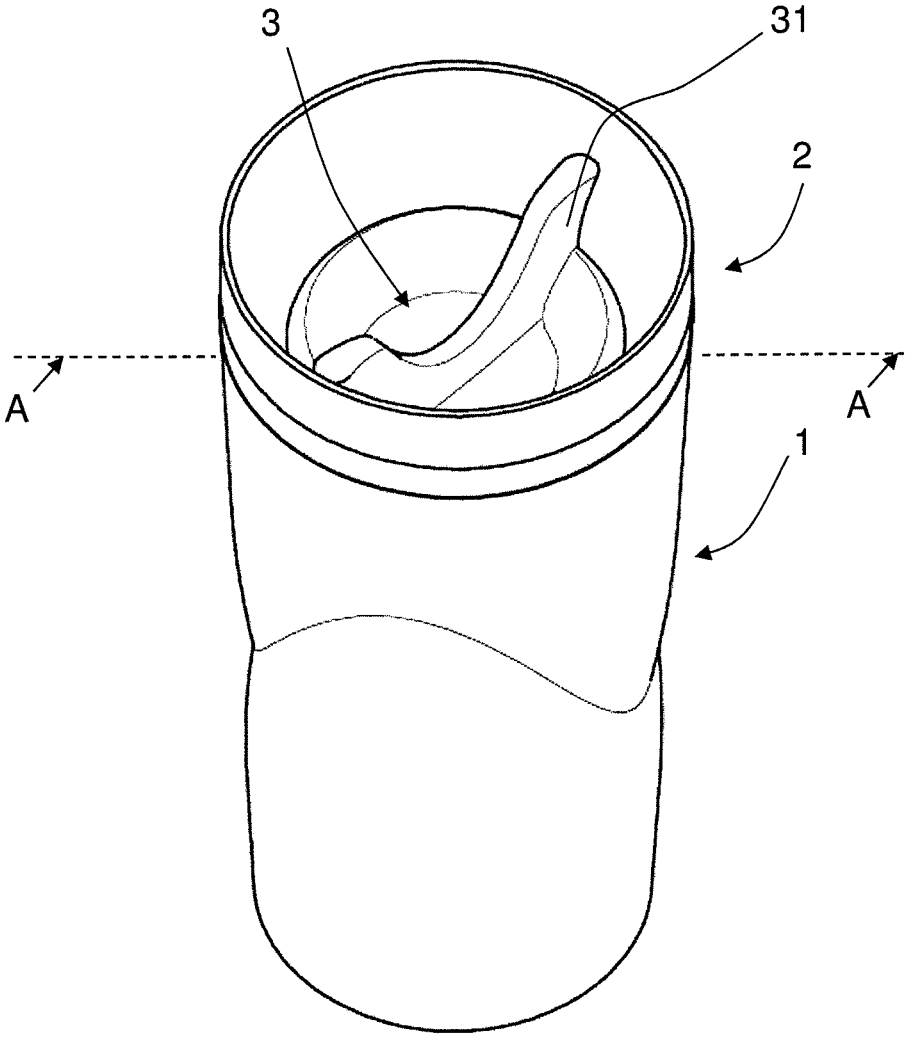
FIG. 1 shows a perspective view of a beverage container having a closure in accordance with a preferred embodiment.
Figure 2:
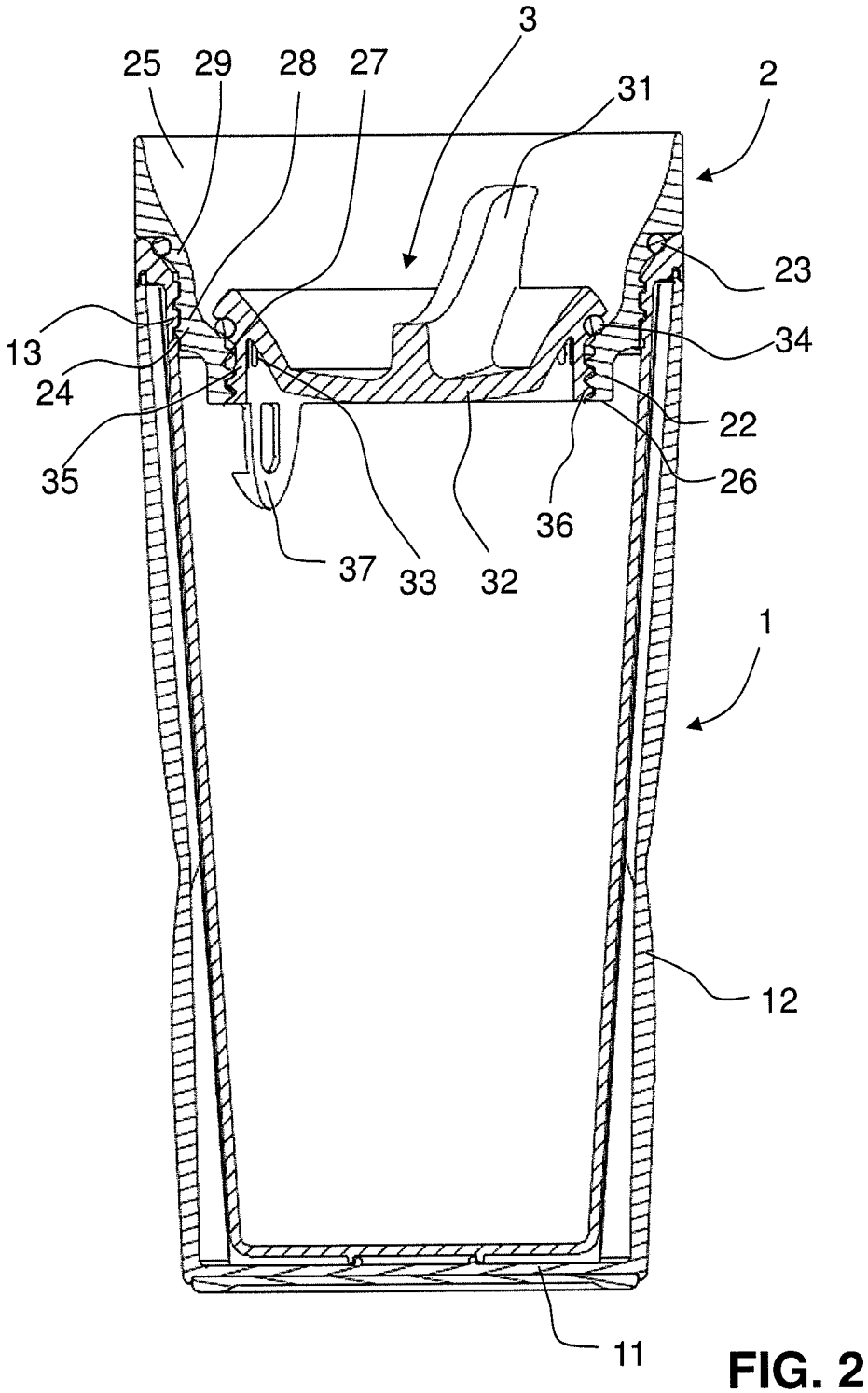
FIG. 2 shows a central longitudinal section in the plane A-A through the beverage container of FIG. 1.

FIGS. 1 and 2 show in different representations a preferred illustrative embodiment of a beverage container having a closure according to the invention.

The beverage container has a vessel 1, an insert element 2 and a closure body 3.

The vessel 1 comprises a vessel bottom 11 and a circumferential side wall 12, the upper rim of which defines an upper opening. In the present representations, the vessel is represented as non-transparent (opaque), but it can also be transparent or translucent. It can take the form of a plastics vessel, but a vessel made of a metal or glass is also conceivable. The vessel 1 has on the outer side of its side wall 12 relief-like structures, whereby the vessel 1, on the one hand, lies better in the hand of the user and, on the other hand, looks esthetically attractive. The side wall 12 and the bottom 11 of the vessel 1 are here of double-walled design in order to improve the thermal insulation of the vessel 1. The liquid inside the vessel (not represented) hence maintains its temperature (cold or hot) differing from the outside temperature for longer. In addition, the double-walled design of the vessel 1 prevents the user from burning the fingers when taking up the beverage container or, in the case of cold content, prevents the formation of condensation water. The closure according to the invention can also, however, be used in connection with single-walled vessels.

The vessel 1 further has on the radial inner side of the side wall 12 in the region of the vessel opening a connecting structure 13, which is designed as an internal thread. This is connectable to a complementary connecting structure 24 of the insert element 2. The insert element 2 can thereby be sealingly inserted into the vessel opening.

The side wall 12 gently flares from the vessel bottom 11 upward to the vessel opening. The seal between the insert element 2, inserted from above into the opening, and the vessel 1 can thereby be improved, in that the insert element 2 is easily pushed or screwed further into the opening. As a result of the diminishing inner diameter of the vessel 1, the seal between the vessel 1 and the insert element 2 becomes better the further the insert element 2 is screwed into the vessel 1. The upper rim of the side wall 12 is of beveled configuration, the inner diameter of the vessel 1 increasing in this region from bottom to top. The possible bearing surface for a sealing element 23, arranged on the insert element 2, on the upper edge of the side wall 12 of the vessel 1 is thereby enlarged.

Figure 3:
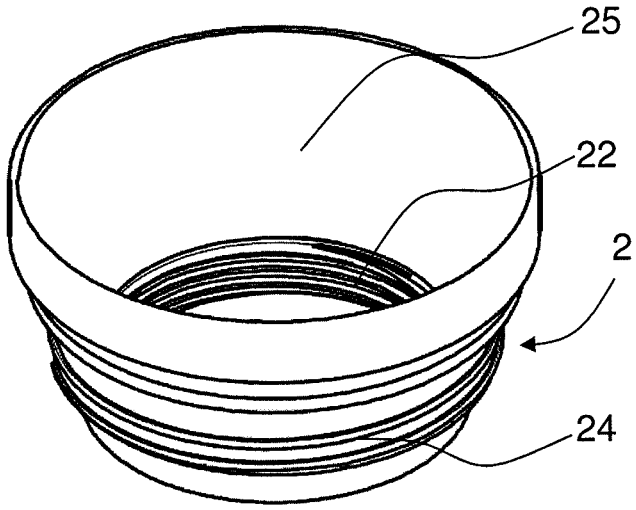
FIG. 3 shows a perspective view of an insert element from diagonally above.
Figure 4:
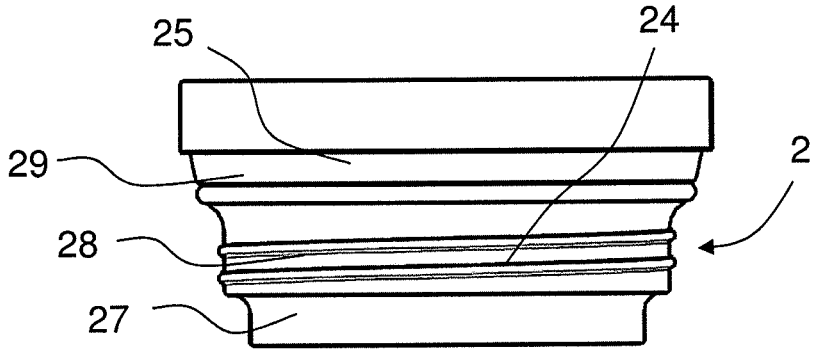
FIG. 4 shows a side view of the insert element of FIG. 3.
Figure 5:
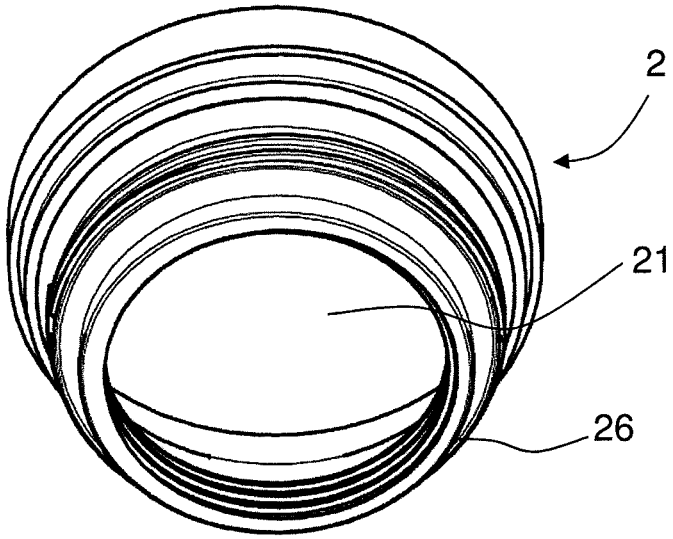
FIG. 5 shows a perspective view of the insert element of FIG. 3 from diagonally below.
Figure 6:
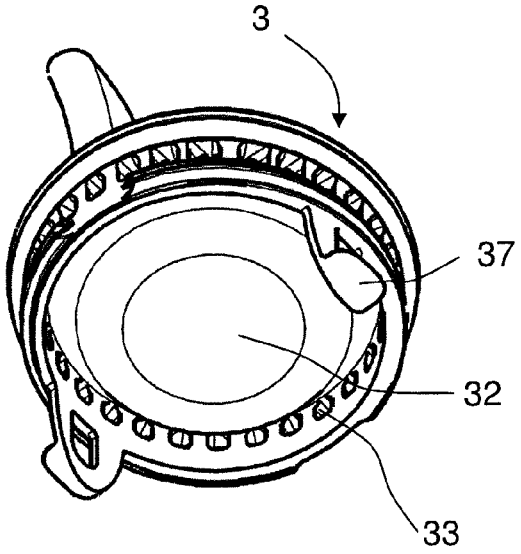
FIG. 6 shows a perspective view of a closure body from diagonally below.
Figure 7:
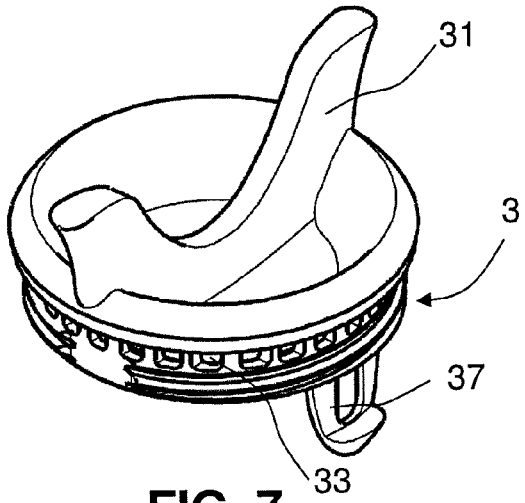
FIG. 7 shows a perspective view of the closure body of FIG. 6 from diagonally above.
Figure 8:
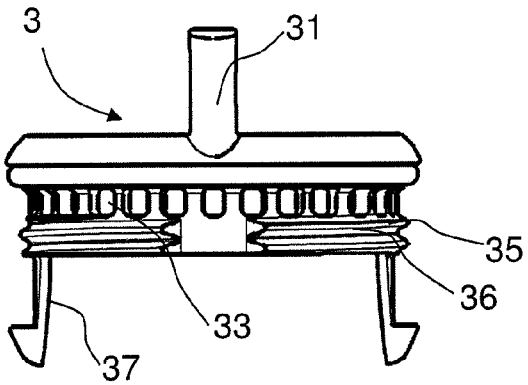
FIG. 8 shows a side view of the closure body of FIG. 6.
Figure 9:
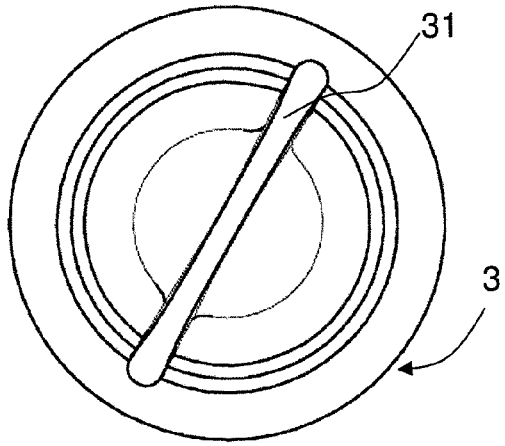
FIG. 9 shows a top view of the closure body of FIG. 6.

The insert element 2, represented individually in FIGS. 3 to 5, has a circumferential side wall surrounding a vertical, continuous closure opening 21. The side wall of the insert element 2 ends at the bottom with a lower edge 26, which serves as a stop for the hooks 37 (described further below) arranged on the closure body 3 in order to prevent the user from completely removing the closure body 3 from the insert element 2.

The insert element 2 can be subdivided into three portions 27, 28, 29 situated one above the other, as can clearly be seen in FIGS. 2 and 4. The substantially cylindrical bottommost portion 27 has the smallest inner and outer diameter in comparison to the other portions 28, 29 and bears on its inner side an engaging structure 22 in the form of an internal thread. The engaging structure 22 serves to receive a complementary engaging structure 36, which is arranged on the closure body 3 insertable into the insert element 2. When the insert element 2 is inserted in the vessel 1, the outer side of this bottom portion 27 is arranged at a distance from the inner side wall 12 of the vessel 1.

The bottom portion 27 of the insert element 2 merges at its upper end into the middle portion 28, the side wall of the insert element 2, in the transition region from the bottom portion 27 to the middle portion 28, flaring radially upward. The middle portion 28 has both a larger inner diameter and a larger outer diameter than the bottom portion 27 and likewise has a substantially cylindrical form on the outside. On the outer side of the middle portion 28 is arranged a connecting structure 24, which is configured as an external thread. The outer diameter of this middle portion 28 is slightly smaller than the inner diameter of the vessel 1 in the region of the vessel opening, and the external thread 24 of the insert element 2 is configured so as to be complementary to the internal thread 13 of the vessel 1. The insert element 2 can be inserted from above into the vessel 1 and connected thereto via the two complementary threads 13, 24. The connecting structures 13, 24 do not necessarily have to be configured as threads, however, but can also be designed as ribs, grooves, recesses, etc., which are respectively complementary to each other. A bayonet-type closure, for example, would also be conceivable, or the insert part 2 could be bonded or welded to the vessel 1.

The middle portion 28 of the insert element 2 merges at its upper end directly into the top portion 29. The latter forms a raised, circumferential rim in the form of a funnel region 25, which flares upward toward a drinking edge. The upper rim, i.e. the drinking edge, of the top portion 29, and thus of the insert element 2, here projects fully over the closure body 3 when this is inserted in the insert element 2. The top portion 29 widens in longitudinal section, viewed from bottom to top, firstly via a convex and then via a concave surface. This thereby formed funnel region 25 serves the user as a drinking aid. In the pouring-out or drinking process, the liquid escaping through the closure body 3 does not therefore flow over all the sides of the beverage container in an uncontrolled manner, but is collected in the funnel region 25 of the insert element 2 and leaves this in bunched form. The funnel region 25 has a vertical height necessary for this. In addition, the raised funnel region 25 prevents the user from banging against the closure body 3 with the nose or lip, for example, when drinking directly from the beverage container, when this is tilted.

On the radial outer side of the insert element 2 is arranged a sealing element 23. For this purpose, the side wall of the insert element 2 forms on its outer side, in the region of the upper portion 29, a right-angled edge, beneath which the sealing element 23 is disposed. A small projection, pointing outward from the side wall, holds the sealing element 23 in its position. When the insert element 2 is inserted in the vessel 1, the sealing element 23 rests on the beveled upper edge of the side wall 12 of the vessel 1 and thus mutually seals the insert element 2 and the vessel 1. The sealing element 23 can be constituted for example, as in this embodiment, by an O-ring. The side wall of the insert element 2 is configured on its outer side, in the upper part of the funnel region 25, such that it forms, from the right-angled edge upward, a continuation of the vessel side wall 12.

The insert element 2 is configured in two parts, comprising the insert body per se and the sealing element 23. The one-piece insert body can be made of plastic, for example, by injection molding.

The closure body 3, represented individually in FIGS. 6 to 9, has a top surface 32, a circumferential apron 36, a grip element 31 and hooks 37. The closed top surface 32 is curved gently downward in a central middle part and has an outer marginal region, which is connected to the middle part by a kink and rises upward. On the top side of the top surface 32 is arranged the thumbscrew-like grip element 31, which extends diametrically over the whole of the top surface 32. In the region of the outer marginal region of the top surface 32, the grip element 31 has upwardly protruding projections, which project significantly upward over the topmost point of the top surface 32. For their part, however, once the closure body 3 is inserted in the insert element 2, said projections are overtopped by the upper edge of the side wall of the insert element 2. Toward the middle of the top surface 32, the height of the grip element 31 significantly decreases, whereby the user does not bang against the grip element 31 with the nose when drinking directly from the beverage container with the closure body 3 inserted therein. In the middle of the top surface 32, the grip element 31 projects upward from the outer edge of the top surface 32.

On the outer side of the outer rim of the top surface 32, the closure body 3 has a radially outwardly directed projection, beneath which is arranged a sealing element 34. The sealing element 34, here constituted by an O-ring, is held in position downward by a smaller, second projection, which is likewise directed outward. When the closure body 3 is inserted in the insert element 2 and screwed fully into it, the sealing element 34 rests on the beveled transition between the bottom portion 27 and the middle portion 28 of the insert element 2 and thus, together with the top surface 32 of the closure body 3, completely seals off the vertical closure opening 21 of the insert element 2.

Directly beneath the sealing element 34, close to the outer rim of the top surface 32, a circumferential apron 35 extends downward. The small projection beneath the sealing element 34 is here arranged on the outer side of this apron 35, at the upper end thereof. In this embodiment, the apron 35 extends downward precisely as far as the height of the lowest point of the top surface 32. On its radial outer side, the apron has an engaging structure 36, which is here configured as an external thread. This external thread 36 is configured so as to be complementary to the internal thread 22 of the insert element 2, whereby the closure body 3 can be inserted into the insert element 2 and can be connected thereto by mutual engagement of the two threads. The external thread 36 can, but does not necessarily have to be configured continuously in the peripheral direction. In the present embodiment, the external thread 36 is interrupted at two diametrically opposing sites, as can be seen from FIGS. 6 to 8.

Above the external thread 36 and beneath the sealing element 34, a plurality of discharge openings 33 in the form of through holes are arranged in the apron 35. The discharge openings 33 are here arranged evenly along the peripheral direction of the apron 35. In a first position of the closure body 3 in the insert element 2, the closure body is screwed as far as possible into the insert element 2, whereby the sealing element 34 rests sealingly on the insert element 2 and the closure opening 21 is thus sealingly closed. In a second position, by contrast, though the closure body 3 is inserted in the insert element 2, the engaging structures 22, 36 do not engage in one another, or only in small measure. In this second position, the sealing element 34 is in a position distant from the insert element 2, and the discharge openings 33 are in a position above the bottom portion 27 of the insert element 2. By screwing, the position of the closure body 3 between the first and the second position relative to the insert element 2 can thus be changed in the vertical direction. The discharge openings 33 in the second position thus open up passages for a liquid from the inside of the beverage container outward. The liquid can hence reach the discharge openings 33 by making its way through the space between the apron 35 and the outer, rising marginal region of the top surface 32. Starting from the discharge openings 33, the liquid then makes its way beneath the sealing element 34 and above the bottom portion 28 of the insert element 2 into the funnel region 25 of the insert element 2, where the liquid is collected and bunched as described above. By the closure body 3 being screwed only partially, but not fully into the insert element 2, the cross-sectional area of the passages is variable and can be optionally adjusted by the user. That is to say that the user chooses an optional position of the closure body 3 between the first and the second position in order to regulate the escaping liquid quantity.

On the lower margin of the apron 35 are arranged radially outward pointing hooks 37. A hook 37 here consists of an elastic portion extending downward from the apron 35, as well as an outwardly directed projection attached to the lower end of this portion. In this embodiment, the downwardly extending portion comprises two struts, which at the lower end are connected by the outwardly directed projection. The hooks 37 thereby have a certain flexibility, which is advantageous, as stated further below. The length of the downwardly extending portion of the hooks 37 is chosen such that it is slightly longer than the height of the internal thread 22 or of the bottom portion 27 of the insert element 2. As a result, the closure body 3 can be fully unscrewed from the insert element 2, yet a complete removal of the closure body 3 from the insert element 2 is prevented by the hooks 37. If the closure body 3 is namely withdrawn upward from the insert element 2, the outwardly directed projections of the hooks 37 butt against the lower edge 26 of the insert element 2, and any further withdrawal is thereby prevented. In this way, the closure body 3 cannot fall out of the rest of the container during drinking or if the beverage container tips over. The danger of the user getting scalded by the escaping liquid, or getting wet or losing the closure body, is thereby substantially reduced.

For cleaning, the insert element 2 can be unscrewed from the vessel 1, however, and the user can remove the closure body 3 from the insert element 2 by pressing the hooks 37 radially inward. For this reason, the hooks 37 have a certain flexibility. Preferably, precisely two hooks 37 are present on the closure body 3, whereby the user can easily press the hooks 37 inward by the use of, for example, thumb and index finger. In the present illustrative embodiment, two hooks 37 are attached to the apron 35, which hooks are arranged on respectively diametrically opposing sides. More than two hooks 37 can also, however, be present.

The closure body 3 is configured in two parts, comprising a basic element and a sealing element 23. The basic element is made of plastic, for example, by injection molding.

In another embodiment, the discharge openings 33 are configured as cut-outs, which are open toward the lower end of the apron 35. The cut-outs here overlap with the external thread 24 applied to the apron 35, in that they constitute an interruption of this external thread 24. As a result of the external thread 22 being unscrewed from the internal thread 36 of the insert element 2, passages outward through the cut-outs become free for the liquid contained in the vessel. Depending on how far the closure body is unscrewed from the insert element, a greater or lesser area of the cut-outs projects over the internal thread 22 of the insert element 2, whereby, accordingly, the cross-sectional area of the passages is variable.

In a further embodiment, the insert element 2 is dispensed with or forms a part of the vessel by being integrally connected thereto. To this end, the vessel has in the region of its upper opening an engaging structure, for example in the form of an internal thread, configured so as to be complementary to the engaging structure 36 of the closure body 3. The closure body 3 can thus in this case be inserted directly into the vessel and can be connected thereto via the engaging structures. Beneath the engaging structure of the vessel, furthermore, projections can be present, which form a lower edge against which the hooks 37 of the closure body 3 butt when this is withdrawn from the vessel. The engaging structure can also, however, itself be configured as an element protruding inward from the side wall of the vessel and have a lower edge for the abutment of the hooks 37. Above the engaging structure or the internal thread, the vessel has in this embodiment a funnel region suitable for collecting and bunching the liquid escaping through the discharge openings 33.

The invention is not of course limited to the above illustrative embodiments and a lot of modifications are possible. In particular, for instance, the discharge openings 33 can be arranged differently. For example, they can overlap with a part of the external thread 36 of the closure body 3 and thus constitute an interruption of this engaging structure 36. The top surface 32 of the closure body 3 can likewise be differently configured and can, for example, be flat or curved upward. The grip element 31 can also have a different shape. Furthermore, the sealing elements 23 and 34 can be omitted, or configured in one piece with the insert element or the closure body, for example by two-component injection molding. A lot of further modifications are possible.

LIST OF REFERENCE NUMERALS

| | | | |
|---|---|---|---|
| 1 | vessel | 28 | middle portion |
| 11 | vessel bottom | 29 | top portion |
| 12 | vessel side wall | 3 | closure body |
| 13 | internal thread | 31 | grip element |
| 2 | insert element | 32 | top surface |
| 21 | closure opening | 33 | discharge openings |
| 22 | internal thread | 34 | sealing element |
| 23 | sealing element | 35 | apron |
| 24 | external thread | 36 | external thread |
| 25 | funnel region | 37 | hooks |
| 26 | lower edge | | |
| 27 | bottom portion | | |

The invention claimed is:

1. A closure for a beverage container, comprising an insert element for being inserted in a vessel, the insert element having a bottom portion, a middle portion and a top portion as well as a continuous closure opening going through each of said portions, the bottom portion having an inner side with a first engaging structure, which first engaging structure is configured as an internal thread, the middle portion comprising a connecting structure for connecting the insert element to a vessel and the top portion comprising a raised, circumferential rim which extends upward from the first engaging structure and forms a drinking edge or pouring edge; and a closure body insertable into the closure opening of the insert element and having a closed top surface adapted for closing the closure opening of the insert element and a circumferential apron extending downward from the top surface, which apron has a plurality of discharge openings in the form of through holes distributed evenly along a peripheral direction in a downwardly extending part of the apron, and a second engaging structure complementary to the first engaging structure, said second engaging structure being configured as an external thread and being arranged below the discharge openings or such that it overlaps with the discharge openings, the engaging structures being configured such that, when said first engaging structure and said second engaging structure are operatively engaged, (i) said top surface of said closure body is disposed below said top portion and (ii) the closure body, by rotating the top surface, in order to unscrew the second engaging structure from the first engaging structure, is movable in the vertical direction relative to the bottom portion of the insert element between a first position, in which it seals the closure opening, and a second position, in which the discharge openings are in a position above the bottom portion of the insert element and open up passages for a liquid, whereby the amount of liquid passing through said openings is variable.

2. The closure as claimed in claim 1, wherein at least two downwardly projecting, radially outward pointing hooks are arranged on the apron, which hooks prevent complete removal of the closure body from the insert element by butting against a bottom edge of the insert element as the closure body is withdrawn from the insert element.

3. The closure as claimed in claim 1, wherein the closure body has a sealing element, which is arranged on a radial outer side of the apron above the discharge openings and which in the first position comes to lie between the closure body and the insert element and thereby seals off the closure opening.

4. The closure as claimed in claim 1, wherein the passages have a cross-sectional area which is variable by the position of the closure body between the first and the second position.

5. The closure as claimed in claim 1, wherein the discharge openings are configured as through holes.

6. The closure as claimed in claim 5, wherein the discharge openings are arranged above the second engaging structure.

7. The closure as claimed in claim 1, wherein the discharge openings are configured as cut-outs, which are open toward the lower end of the apron.

8. The closure as claimed in claim 1, wherein the discharge openings are arranged such that they overlap with the second engaging structure.

9. A beverage container, having:

a closure with an insert element for being inserted in a vessel, the insert element having a bottom portion, a middle portion and a top portion as well as a continuous closure opening going through each of said portions, the bottom portion having an inner side with a first engaging structure , which first engaging structure is configured as an internal thread, the middle portion comprising a connecting structure for connecting the insert element to a vessel and the top portion comprising a raised, circumferential rim which extends upward from the first engaging structure and forms a drinking edge or pouring edge; and with a closure body insertable into the closure opening of the insert element and having a closed top surface adapted for closing the closure opening of the insert element and a circumferential apron extending downward from the top surface, which apron has a plurality of discharge openings in the form of through holes distributed evenly along a peripheral direction in a downwardly extending part of the apron, and a second engaging structure complementary to the first engaging structure, which second engaging structure is configured as an external thread and being arranged below the discharge openings or such that it overlaps with the discharge openings, the engaging structures being configured such that, when said first engaging structure and said second engaging structure are operatively engaged, (i) said top surface of said closure body is disposed below said top portion and (ii) the closure body, by rotating the top surface, in order to unscrew the second engaging structure from the first engaging structure, is movable in the vertical direction relative to the insert element between a first position, in which it seals the closure opening, and a second position, in which the discharge openings are in a position above the bottom portion of the insert element and open up passages for a liquid, whereby the amount of liquid passing through said openings is variable, and an upwardly open vessel having a vessel bottom, an upper vessel opening and a circumferential vessel side wall, the insert element being insertable into the upper vessel opening and being connectable to the vessel side wall.

10. The beverage container as claimed in claim 9, wherein the vessel is of double-walled configuration.

11. The beverage container as claimed in claim 9, wherein, for the connection of the vessel to the insert element, the vessel side wall has in the region of the upper vessel opening on the radial inner side a first connecting structure, and wherein the insert element has on its outer side a second connecting structure, which is configured so as to be complementary to the first connecting structure.

12. The beverage container as claimed in claim 11, wherein the first connecting structure is configured as an internal thread and the second connecting structure as an external thread.

13. The beverage container as claimed in claim 1, wherein the closure body being moveable vertically cooperates with the discharge openings in the downwardly projecting apron to permit the user to continuously adjust the size of the passage for the liquid streaming out of the beverage container during drinking.

14. The beverage container as claimed in claim 9, wherein the closure body being moveable vertically cooperates with the discharge openings in the downwardly projecting apron to permit the user to continuously adjust the size of the passage for the liquid streaming out of the beverage container during drinking.

* * * * *